United States Patent [19]

Rodgers

[11] Patent Number: 4,758,334

[45] Date of Patent: Jul. 19, 1988

[54] CONTINUOUS FEED AND DISCHARGE MINERAL CONCENTRATOR WITH RIFFLES ANGLED RELATIVE TO A LONGITUDINAL AXIS

[76] Inventor: Henry W. Rodgers, 9725 W. 21st Ave., Lakewood, Colo. 80215

[21] Appl. No.: 884,861

[22] Filed: Jul. 16, 1986

Related U.S. Application Data

[63] Continuation of Ser. No. 663,204, Oct. 22, 1984, abandoned.

[51] Int. Cl.[4] ..... B03B 5/06

[52] U.S. Cl. ..... 209/441; 209/443; 209/504; 209/506

[58] Field of Search ..... 209/441, 442, 443, 437, 209/506, 500, 504

[56] References Cited

U.S. PATENT DOCUMENTS

| | | | |
|---|---|---|---|
| 661,886 | 11/1900 | Monell | 209/441 |
| 678,793 | 7/1901 | Look | 209/441 |
| 680,938 | 8/1901 | Paul | 209/442 |
| 732,319 | 6/1903 | Rogers et al. | 209/441 |
| 780,031 | 1/1905 | Forster | 209/441 |
| 794,928 | 7/1905 | Dodd | 209/441 |
| 953,520 | 3/1910 | Dykes | 209/442 |
| 980,202 | 1/1911 | Christensen | 209/441 |
| 995,449 | 6/1911 | Fronz | 209/504 |
| 1,116,246 | 11/1914 | Crane | 209/441 |
| 1,197,398 | 9/1916 | Richards | 209/441 |
| 1,282,108 | 10/1918 | Nicholls | 209/345 |
| 1,405,018 | 1/1922 | Shepherd | 209/485 |
| 1,423,777 | 7/1922 | Newman et al. | 209/441 |
| 1,429,845 | 9/1922 | Cooley | 209/506 |
| 1,442,186 | 1/1923 | Sperry | 209/441 |
| 1,534,536 | 4/1925 | Meyer | 209/481 |
| 1,593,728 | 7/1926 | Stebbins | 209/504 |
| 1,642,843 | 9/1927 | Deister et al. | 209/441 |
| 1,781,810 | 11/1930 | Dyer | 209/441 |
| 1,799,694 | 4/1931 | Lide | 209/504 |
| 1,822,840 | 9/1931 | Davis | 209/485 |
| 2,325,340 | 7/1943 | Oberdick | 209/504 |
| 4,078,996 | 3/1978 | Cohen-Alloro et al. | 209/504 |
| 4,150,749 | 4/1979 | Stevens | 209/437 |

FOREIGN PATENT DOCUMENTS

| | | | |
|---|---|---|---|
| 9153 | 5/1916 | United Kingdom | 209/504 |

OTHER PUBLICATIONS

Robert H. Richards, Charles E. Locke, Reinhardt Schuhmann, *Textbook of Ore Dressing,* 3rd Edition, McGraw-Hill Book Company, Inc., 1940, pp. 210–225.

*Primary Examiner*—Kenneth M. Schor
*Attorney, Agent, or Firm*—Gregg I. Anderson

[57] ABSTRACT

A mineral concentrator, including a main support base interconnected to a deck by a flexible support and an oscillator assembly, for recovery of free minerals from a mixture of screened raw materials is disclosed. A symmetrical deck is divided in equal parts by a longitudinal center line plane and includes two sloping surfaces extending laterally and longitudinally downwardly and away from a feed end of said deck. Water and raw material are continuously supplied at the feed end of said deck and moved along the sloping surfaces. First riffles are defined in association with the sloping surfaces and generally perpendicularly to a fall line. The first riffles intercept said raw material and terminate at a point allowing the water and entrained waste materials to fall to the side of the deck for removal from troughs positioned thereat. Relatively longer, narrower and shallower second riffles are interspersed parallel to the first riffles for carrying relatively denser material toward the concentrate end of the deck. Waste material is washed away from the relatively denser material. A second water supply establishes a film which covers the sloping surfaces and in which the raw material is entrained. The second riffles terminate and transfer concentrate material to relatively wider and deeper third riffles, which are also parallel to the first and second riffles, further separation of less dense minerals taking place at the transfer. The third riffles communicate with fourth riffles, parallel to said center line, which fourth riffles carry said concentrate to a discharge or collection trough.

6 Claims, 6 Drawing Sheets

CONTINUOUS FEED AND DISCHARGE MINERAL CONCENTRATOR WITH RIFFLES ANGLED RELATIVE TO A LONGITUDINAL AXIS

This application is a continuation of application Ser. No. 663204 filed Oct. 22, 1984 and now abandoned.

BACKGROUND OF THE INVENTION

1. Field of the Invention

The present invention relates to mineral concentrators which concentrate specified, relatively dense minerals, particularly gold, from a raw material mixture containing both the concentrate and less dense particles of classified sizes. The raw material is immersed in water and moved by the water and force of gravity over a separation surface which is in motion. More particularly, the present invention relates to oscillating table concentrators of the type in which a preprocessed feed material or raw material is continuously fed to a feed end of the concentrator and is continuously discharged from a discharge end of the concentrator, segregating denser minerals in the process.

2. Description of the Prior Art

Particularly in connection with gold recovery, though useful in recovering other minerals as well, it is known to wash a raw material mixture including relatively denser particles over a moving, separation surface. Waste materials, including tailings and middlings, flow with wash water to one portion of a concentrator apparatus, while the mineral concentrate is collected and moved to another part of the concentrator apparatus as a result of a relatively higher density. It is common practice to use water on the separation surface to help stratify and move the raw material along various flow paths established according to the different mineral specific gravities constituting the raw material.

The simplest concentrator is a gold pan wherein a shaking and swirling action is imparted to the raw material and water held in a pan. Lighter materials are systematically washed out of the pan, leaving the denser minerals and gold at the bottom of the pan. Gold panning is an art that requires patience and skill in order to separate gold from relatively dense mineral concentrates. It is also useful in processing only small volumes of raw material.

Another type of concentrator having intermittent feed and discharge, as does panning, is the cradle or rocker. An elevated screen receives the raw material to be processed and water is poured onto the raw material washing the fine material through the screen. The coarse material of a greater size is removed from the screen and thrown away. The cradle is rocked about a longitudinal axis during the washing process and any fine material washed through the screen strikes a canvas apron, where some of the gold or mineral concentrate is held for recovery. From the apron, the raw material is washed over a series of riffles transverse to the longitudinal axis, where additional gold settles out, the waste material exiting at a tail end of the cradle. Again, gold is difficult to separate from dense mineral concentrates and the volume processed is quite small.

Jerking and bumping tables have a planar separation surface or deck that is oscillated along a longitudinal axis. Both jerking and bumping tables operate on principles relating to the momentum of the particles of raw material moved by wash water across a single sloping surface comprising a deck. The oscillation of a jerking table is adjusted so that a relatively higher velocity is imparted in one oscillation direction than in the other direction. The result of the different velocities is a net particle movement in the direction of lesser velocity. The bumping table has identical velocities in either direction along the longitudinal axis, but an intermittent force is applied directly to the deck in a direction toward a head or feed end. The momentum of the raw materials carries them toward the tail or discharge end.

It is also common practice to separate gold from concentrate produced by prior art devices by amalgamation by mercury. The resultant amalgam is then retorted to separate the gold. The recovery percentage of fine-sized gold is low in all these processes.

The jerking and bumping tables continuously receive raw material at the feed end and continuously discharge raw material and concentrate along particle flow paths. The entire surface or deck is laterally inclined downwardly a few degrees with respect to a horizontal plane so that the water flows across the deck at about right angles to the direction of oscillation. These tables are usually level with reference to a longitudinal attitude, but might have a slight positive or negative inclination, from the feed end to the discharge end. The separation surface includes a series of longitudinally extending narrow riffles. Typically, the riffles are raised and may be established by tacking tapered cleats on the surface of the deck or may be formed of rubber, metal or other substances. In either event, the riffles formed on the surface are relatively narrow and are all of equal cross sectional dimensions at a given position along the length of the deck. Most riffles extend substantially the length of the deck and are numerous in number. Commonly, a series of raised or recessed riffles taper along their length as the discharge end is approached. The riffles terminate on a diagonal line, relative to a longitudinal axis of the deck, defined by connecting ends of the riffles.

It is known to oscillate the deck by a single apparatus combining eccentrics, toggles and springs. Eccentrics alone can be used as can cams, springs and bumping posts in combination. However the deck is shaken, in a jerking table the velocity of the deck toward the feed end of the deck must be more rapid than toward the discharge end of the deck. As has been stated, this relative velocity difference can be established in a bumping table by an intermittent force applied to a deck otherwise oscillating in each direction at the same velocity.

This relative velocity difference tends to move the raw material particles fed onto the deck along distinct flow paths, which paths are in direct relation to the particle size and density. The oscillation is in line with the orientation of the riffles, i.e., along the longitudinal axis. The denser minerals, such as gold, tend to lie in the riffles and move toward the discharge end of the table. The lighter, less dense middlings and tailings, or waste raw material, tend to be displaced from the riffles by denser minerals and washed out of the riffles down the sloping surface of the deck to a side edge of the deck, rather than being moved to the discharge end.

On a rectangular table with longitudinally extending riffles, there will be a separation line between flow paths essentially on the diagonal, separating the deck into two areas. The area of the deck nearest the feed end will discharge waste material while the remaining area of the deck and the riffles extending therealong will tend to carry concentrate to the concentrate or discharge end. It is known to establish the separation line by a flexible bend in the deck itself.

Of the several types of oscillating tables, the Wilfley table is the oldest and most widely used. It requires a substantial foundation or support in order to resist the stress of the vibration induced by oscillating the table at 240 cycles per minute. Motion is imparted to the table deck by a pitman driven by a crank and oscillating the deck through two different toggles. A spring damps the entire system. The frequency of oscillation can run from as low as 150 cycles per minute to as high as 290 cycles per minute, the average being about 240 cycles per minute. The Wilfley table also includes a tilting frame for varying the slope of the deck to meet variations in the raw materials. The riffles, either of the recessed or raised cleat type, are tapered lengthwise and terminate at the concentrate end. The riffles are known to be square, sawtooth, or V-shaped in cross section.

A modification to the Wilfley table, known as the Butchart table, has a different orientation and design for the continuous riffles. Three distinct zones are defined upon the deck. A first stratification zone is similar to Wilfley and includes the deepest part of the riffles. The first zone is longitudinally adjacent a feed box at the feed end of the deck. The second zone is a cleaning zone which consists of an area of riffles bent up the sloping surface towards the water feed side of the deck, defining an angle with a longitudinal axis of the deck which is out of longitudinal alignment with the riffles in the first stratification zone. The deflection of these riffles in the cleaning zone, and in combination with the slope of the deck, produces an uphill flow of material, reversing the normal flow of material along the riffles. The last zone, called the discharge zone, is riffled like the first zone and ends in an unriffled portion like a Wilfley table.

In the Butchart table, stratification occurs quite early when water washes the raw material over the riffles and the waste in channels or troughs nearer the feed end and at the downhill side of the deck. The cleaning zone imparts a different kind of action to the riffles, a "side shake" similar to that of a vanner resulting in further stratification and cleaning of the raw material in this zone of riffles.

Another type of table has come to be known as the Deister table. The Deister table differs from the Wilfley table primarily in that it includes a deck that is not rectangular but rather more of a parallelogram shape.

OBJECTS AND SUMMARY OF THE INVENTION

It is the principal object of the present invention to provide a mineral concentrator that is so effective that it can separate fine gold from other dense minerals contained in a mixture of a preprocessed feed material or raw material.

It is a related object of the present invention to provide a mineral concentrator which has a deck that is configured so that minerals like free gold can be separated from less dense minerals which are very close in density to the gold or other mineral being concentrated.

It is a further related object of the present invention to provide a mineral concentrator for the raw material mixture having a deck configuration that greatly increases the raw material feed rate and percentage of free minerals recovered, particularly very fine "free" gold on the order of minus twenty mesh. It is another object of the present invention to provide a flexible connection between the deck and a rigid support, the flexible connection being variably oscillated by an prime mover device of adjustable frequency and amplitude output.

It is another related object of the invention to provide a prime mover device which can operate either in a jerking mode, wherein relative speeds forward and backward of the deck are different, or in a bumping mode where relative forward and backward speeds are the same and an intermittent bump causes material on the deck to move under its own momentum, or a combination of both movements for quicker, more efficient concentration and separation of the mineral.

It is a further object of the invention to provide a mineral concentrator of the continuous feed and continuous discharge type that can be operated in series with other mining apparatus in a concentration and or separation process.

It is a still further object of the present invention to provide a mineral concentrator wherein the deck has sloping surfaces symmetrical about a vertical plane through a longitudinal center line.

In accordance with the objects of the invention, a mineral concentrator, particularly useful for concentrating dense minerals and even separating gold, includes a rigid support base having mounted thereto a motor as a prime mover and a flexible connection. The flexible connection is further connected to a deck superimposed over the base, allowing longitudinal movement of the deck under the influence of the motor over a predefined relatively small distance. The motor rotatively drives eccentric means connected to the deck, oscillating the deck relative to the base.

The deck is symmetrical about a center line extending longitudinally thereof, the center line bisecting the deck into two laterally and longitudinally pitched sloping surfaces. The concentrator is of the continuous feed and continuous discharge type. The feed area for raw materials, which raw materials are screened and classified to a predetermined size, is at a feed end of the deck, the deck terminating at an end opposite in a discharge or concentrate end. Either side of the deck collects, according to their specific gravities or densitites, relatively light waste materials or tailings, and relatively more dense and heavy minerals or middlings, which middlings displace the waste minerals which is discarded. Denser materials to be concentrated move to the discharge end.

At the feed end of the deck a flat feed area receives the raw material and is in communication with a first water supply for moving the raw material onto the sloping surfaces of the deck. Early stratification and concentration of the raw material occurs here. The sloping surfaces have longitudinally extending riffles of varying length and varying depth and width formed therein in an orientation generally perpendicular to the flow of water. The riffles, which collect dense minerals, make an acute angle with the center line, measured relative to the feed end.

A second feed water supply runs along the center line, about which the sloping surfaces are symmetric. The center line is at the intersection of the sloping surfaces. The second water supply includes numerous outlets along its length, each of which are adjustable as to the amount of water being discharged. Control of the rate of feed of the first feed water supply and second feed water supply, and the rate of oscilation of the entire deck is used to establish the best conditions for concentration of a given mineral. A trough for both tailings and for middlings is provided at either lateral side extent of the deck, and a trough for concentrate at the concentrate end. Discharge holes are provided for all of the troughs from which materials can be washed away as waste or collected as mineral concentrate.

Figures 6, 7A, 7B, 8:
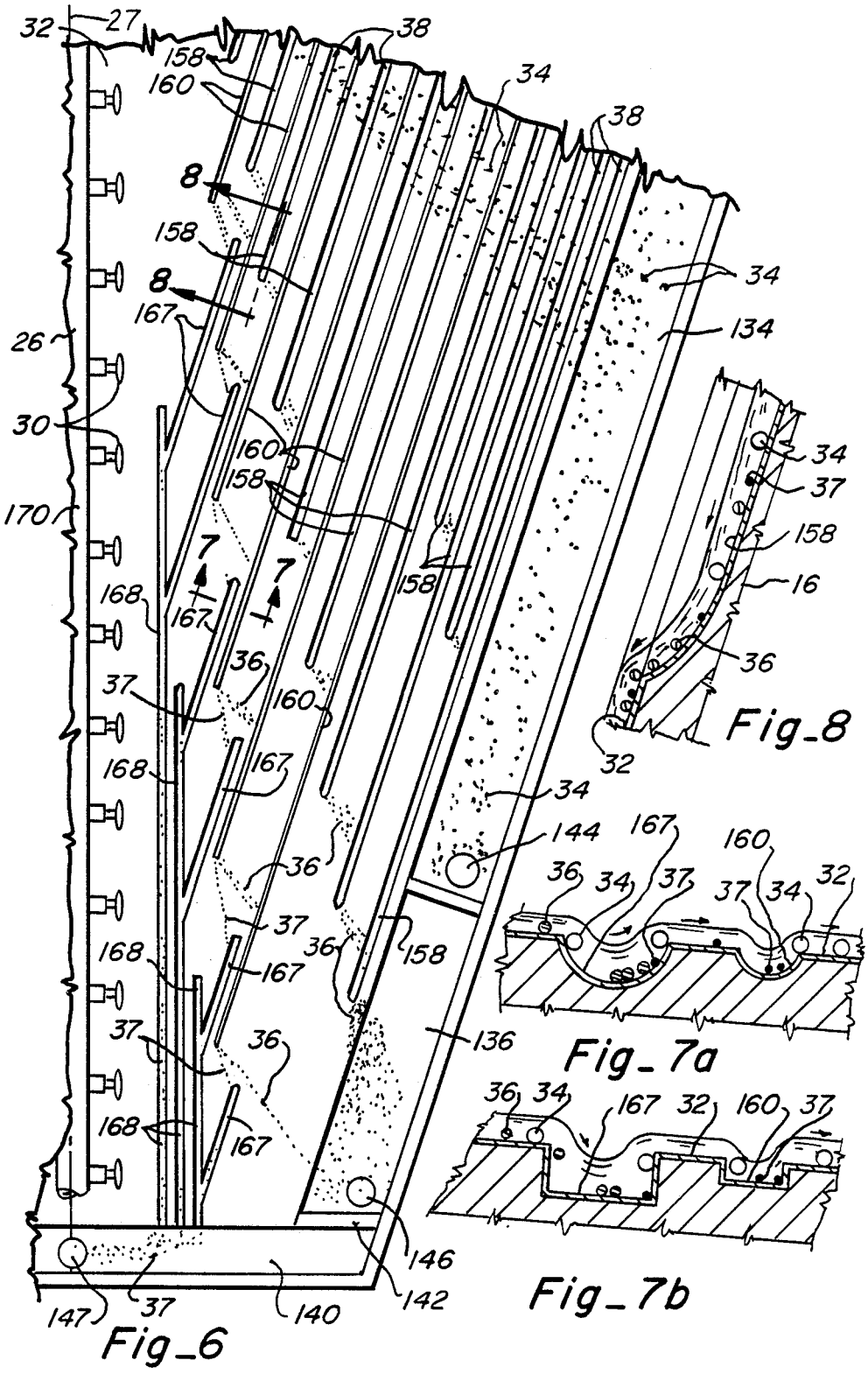
FIG. 6 is an enlarged fragmentary top plan view of a deck of the invention shown in FIG. 1.

FIG. *7a* is a sectional view taken in the plane of line 7—7 of FIG. 6, arcuately shaped riffles being seen in cross section.

FIG. *7b* is an alternative embodiment to the riffles shown in FIG. *7a*.

FIG. 8 is a fragmentary section a view taken in the plane of line 8—8 of FIG. 6.

Figure 9:
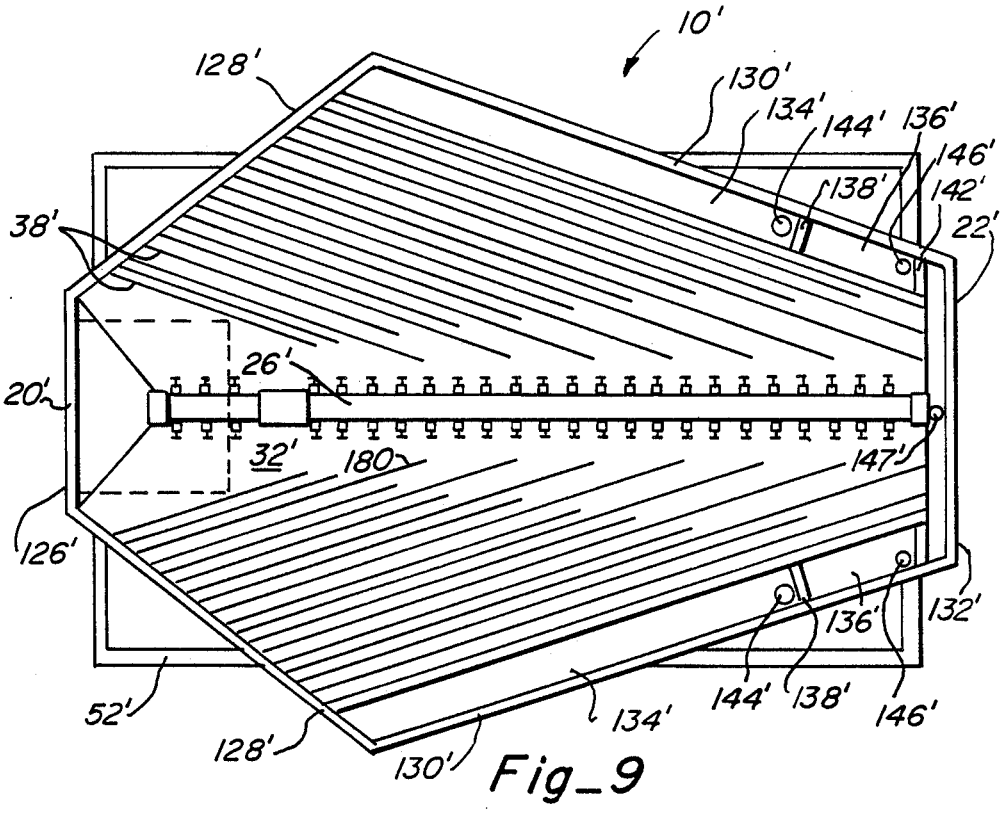

FIG. 9 is a top plan view of an alternative embodiment of the invention.

Figure 10:
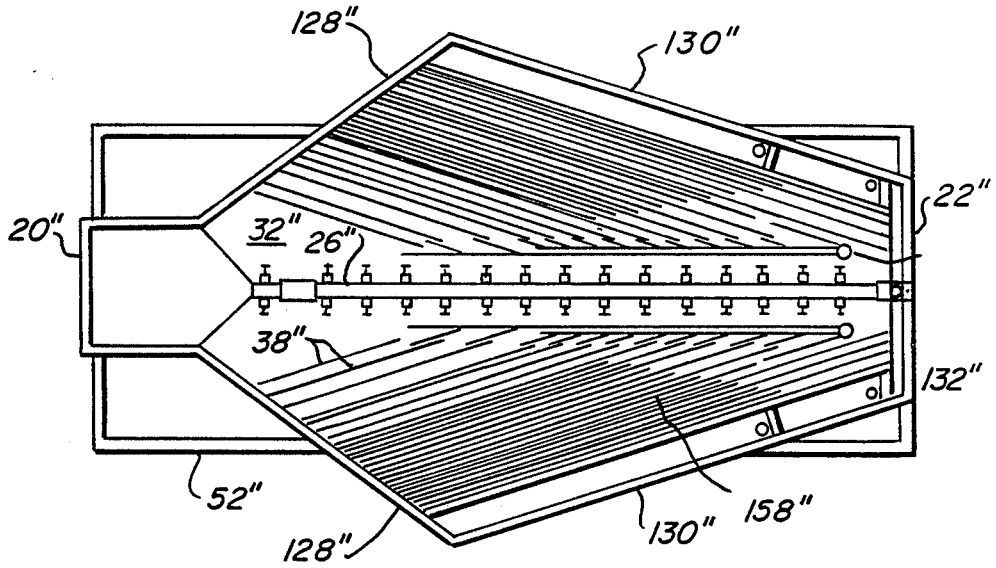

FIG. 10 is a top plan view of a second alternative embondiment of the invention.

Figure 11:
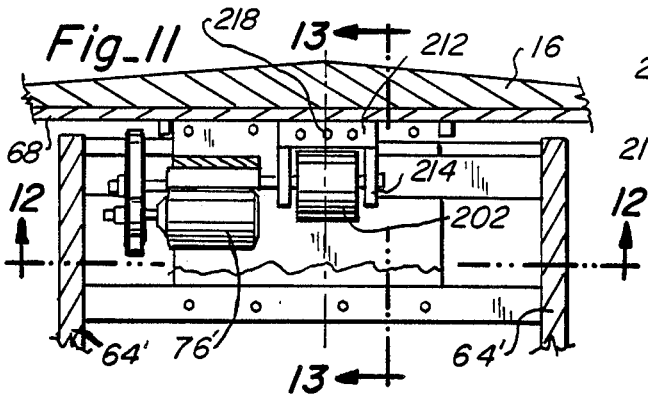

FIG. 11 is a fragmentary sectional view taken transversely of a longitudinal center line of the deck showing an alternative oscillator assembly.

Figure 12:
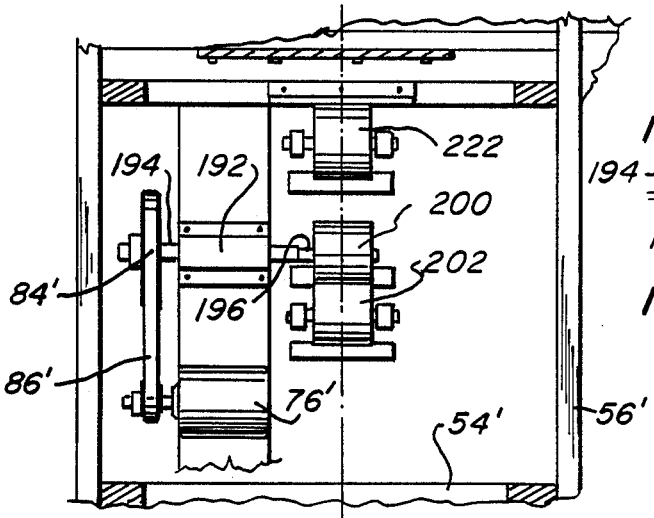

FIG. 12 is a sectional view taken in the plane of line 12—12 of FIG. 11.

Figure 13:
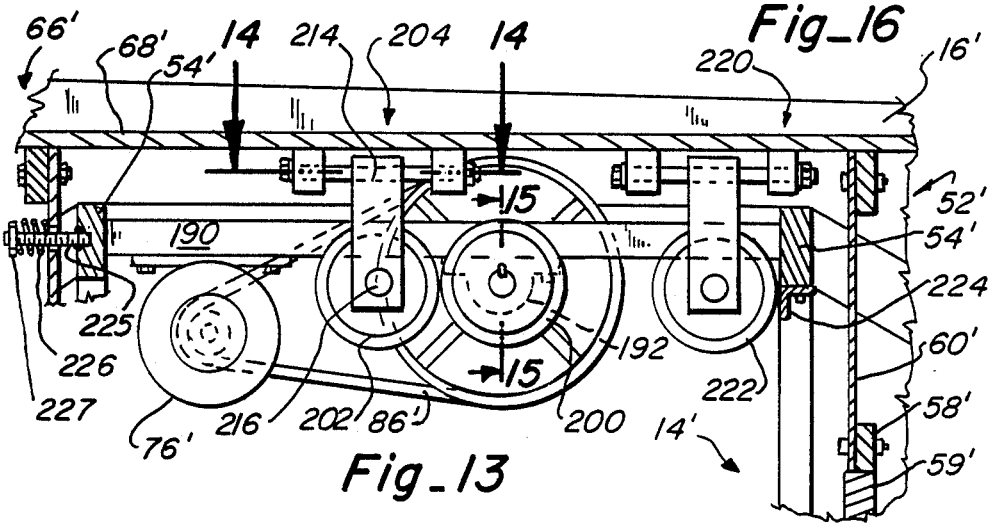

FIG. 13 is a sectional view taken in the plane of line 13—13 of FIG. 11.

Figure 14:
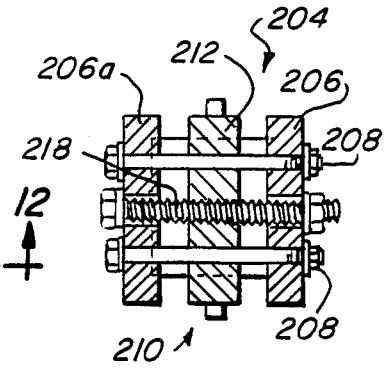

FIG. 14 is a sectional view taken in the plane of line 14—14 of FIG. 13.

Figure 15:
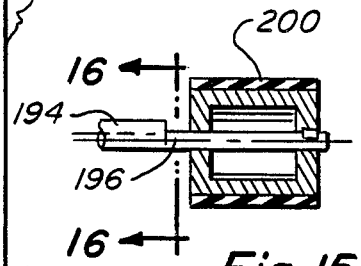

FIG. 15 is a sectional view taken in the plane of line 15—15 of FIG. 13.

Figure 16:
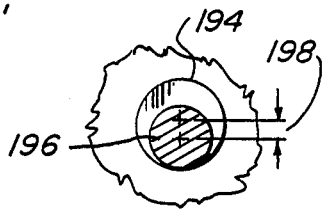

FIG. 16 is a sectional view taken in the plane of line 16—16 of FIG. 15.

DESCRIPTION OF THE PREFERRED EMBODIMENTS

A mineral concentrator 10 is seen in drawing FIGS. 1 through 4 to include a main support base 12, interconnected to a deck 16 by a flexible support 14 and an oscillator assembly 18 for imparting a mid-range frequency oscillation to the deck 16 relative to the main support base 12. The oscillator assembly 18 produces a mid-range frequency on the order of 190 to 300 cycles per minute in the deck 16 relative to the base 12.

The mineral concentrator 10 is of the continuous feed and discharge type. A preprocessed feed material or raw material (not specifically shown) is supplied to the concentrator 10 at a feed end 20. Oscillatory motion, as will be described in detail, together with water impart immediate stratification and a movement to the raw materials from the feed end 20 toward a discharge or concentrate end 22. The raw materials have been previously screened and classified to minus ten mesh as a maximum size, but preferably minus twenty mesh.

A first water supply 24 is located at the feed end 20, while a second water supplies 26 extends longitudinally along the deck 16 above a longitudinal center line 27 (FIGS. 5 and 6) of the deck 16, bisecting the deck 16 into two equal area symmetric sloping surfaces 32. The second water supply 26 includes a plurality of water outlets 28, each having a valve 30 for adjusting the amount of water dispensed onto the deck 16. The deck 16 is divided either side of a vertical plane containing the center line 27 into the two sloping surfaces 32 (FIGS. 3 and 4), each extending downwardly from the second water supply 26 to either lateral side edge of the deck 16 and from the feed end 20 downwardly to the discharge end 22.

The first and second water supplies 24 and 26 respectively, generate a film of water over the entire surface of the deck 16. It will be understood that particles of raw material entrained within the water film are of generally the same screened size but have different specific gravities and densities. The particles flow down the sloping surfaces 32 in different flow paths, as seen diagramically in FIG. 5. Lighter waste material, such as tailings 34, as well as denser middlings 36, will tend to be washed more directly down the sloping surfaces 32 toward the lateral side edges of the deck 16. The heavier more dense particles will tend to travel farther toward the discharge end 22, the heaviest concentrate mineral 37, will travel to the discharge end 22, in a manner as will now be discussed.

A plurality of generally longitudinally extending riffles 38, which are shown as grooves in the sloping surfaces 32, but could be raised ridges, are formed in each of the sloping surfaces 32 of the deck 16. The riffles 38 form an acute angle, relative to the feed end 20, with the center line 27 of the deck 16. The riffles 38 form a path in which denser minerals will move and tend to displace lighter waste materials, which are washed away by water from the water supplies 24 and 26. Once in the riffles 38, the densest concentrate minerals 37 will travel the distance to the discharge end 22 for recovery.

The main support base 12 includes a base platform 40 which rests on the ground or underlying foundation without the need for attachment thereto. The base platform 40 is constructed from a pair of parallel lateral braces 42 interconnected at respective ends by a pair of longitudinal braces 44. The braces 42 and 44 define a rectangular structure onto which three decking panels 46*a*, 46*b* and 46*c* are secured. Foot pads 47 are put at each corners where one of the lateral braces 42 joins to one of the longitudinal braces 44.

Two triangular supports 50 are secured to each of the longitudinal braces 44 at either side of the base platform 40. The triangular supports 50 extend upwardly a predetermined heighth conecting to an upper base structure 52. The upper base structure 52 is constructed from a second pair of lateral braces 54, interconnected by a pair of longitudinal braces 56. The lateral braces 54 generally superimpose the lateral bases 42, while the longitudinal braces 56 generally superimpose the longitudinal braces 44.

Figures 1, 2:
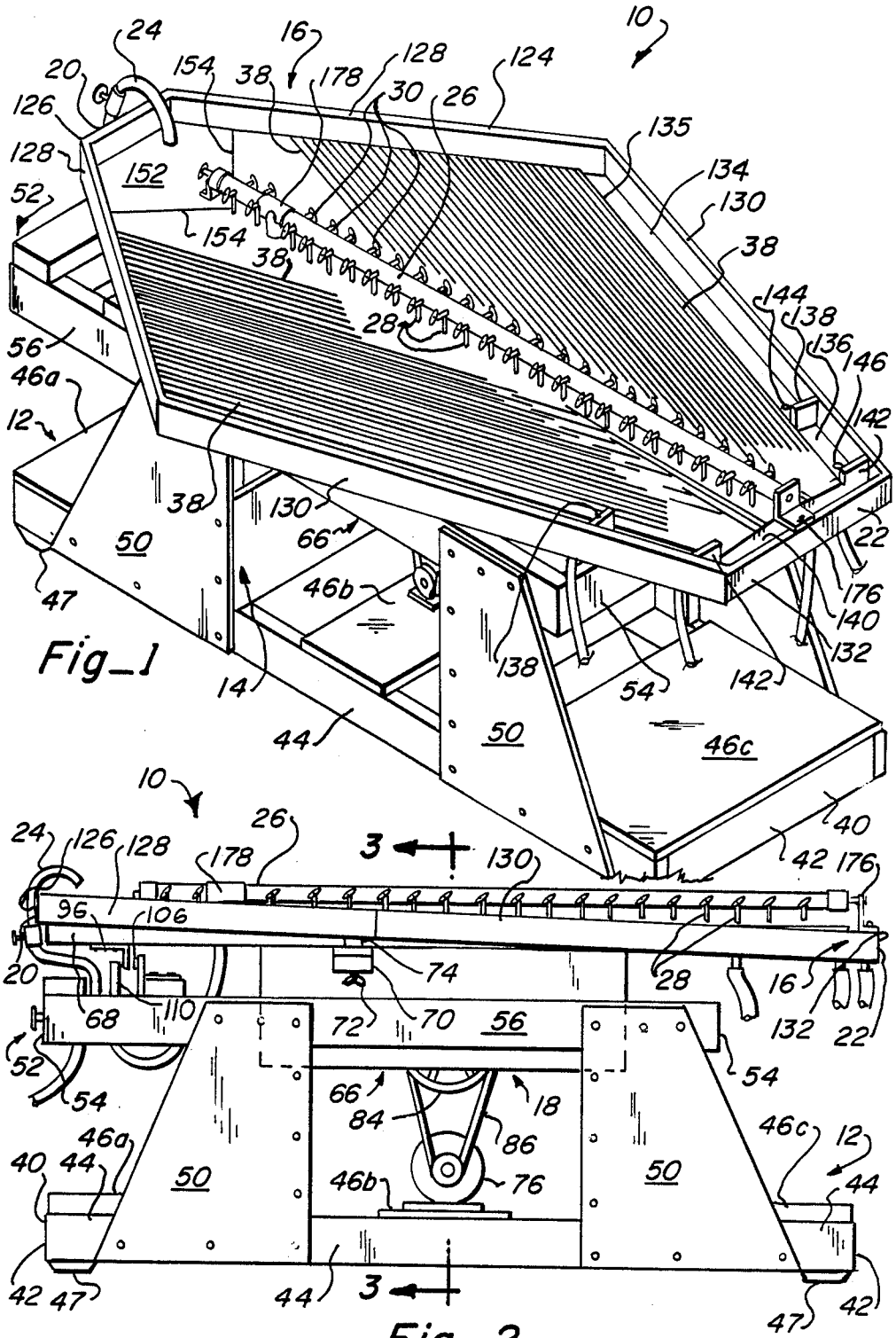
FIG. 1 is a perspective view of a mineral concentrator of the invention.
FIG. 2 is a side elevational view of the invention shown in FIG. 1.
Figure 3:
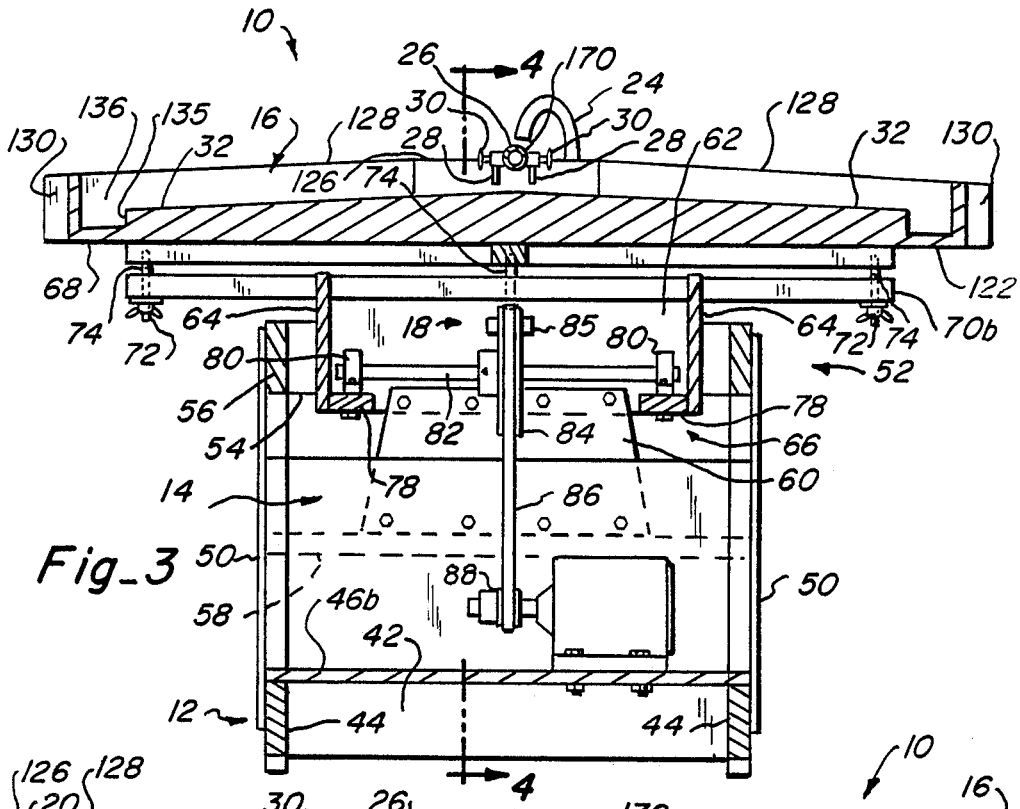
FIG. 3 is a sectional view taken in the plane of line 3—3 of FIG. 2.
Figure 4:
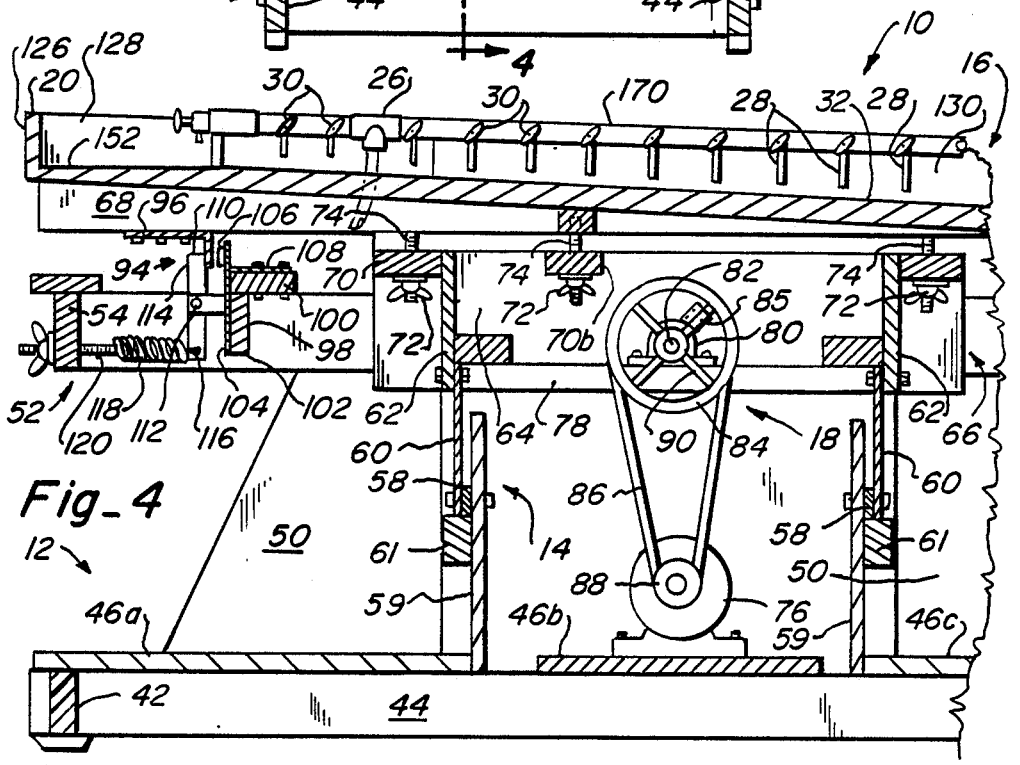
FIG. 4 is a fragmentary sectional view taken in the plane of line 4—4 of FIG. 3.

The flexible support 14 is connected to the main support base 12 at the triangular supports 50. A side support brace 58 is rigidly connected between each pair of triangular supports 50. A rigid panel 59 also connects each pair of triangular supports 50. A first flexible panel 60 is connected to each of the two side support braces 58, as best seen in FIG. 4. The first flexible panel is centered laterally (FIG. 3) with respect to the center line 27 of the concentrator 10. The panel 60 is of generally trapezoidal plan view, connecting along a bottom edge to the side support braces 58 and at a top edge to a second panel 62 extending laterally a slightly greater distance than does the first panel 60. At either lateral side edge, the second panel 62 rigidly connects to a pair of side struts 64 of flat planar configuration. The side struts 64 and second panels 62 define a rigid box structure 66 to which the deck 16 is connected, as will be described shortly, and which is flexibly connected by the flexible panels 60 to the main support base 12.

The box structure 66 is connected to an underdeck 68, which underdeck is integrally formed with, bonded or otherwise connected, as by bolts, to the deck 16. The box struction 66 has three laterally extending cross beams 70*a*, 70*b* and 70*c*. Cross beams 70*a* and 70*c* receive two bolts 72 (FIGS. 3 and 4) therethrough which project upwardly away from the box structure 66. The cross beams 70*a* and 70*c* are connected to the panels 60 of the box structure 66 and between the side struts 64. Cross beam 70*b* is connected by three bolts 72 to the underdeck 68 intermedrate cross beams 70*a* and 70*c*. Cross beam 70*b* extends completely across the width of the deck 16 to provide lateral support, and is also connected to the side struts 64. Spacers 74 on the bolts 72 hold the underdeck 68 at a spaced distance above the box structure 66. The bolts of cross beams 70*a* and 70*c* are secured into the underdeck 68. A deck beam 73 secured to the underdeck 68 receives the bolts 72 associated with cross beam 70*b*. The bolts 72 and spacers 74 can be adjusted for lateral adjustment of the deck 16. It is seen that the underdeck 68 is connected to the box structure 66 as described.

The oscillator assembly 18, as previously mentioned, also interconnects the main support base 12 to the deck 16. A motor 76 is bolted or otherwise secured to the decking panel 46*b* of the base platform 40. A pair of longitudinal beams 78 are secured near a bottommost edge of each of the side struts 64 of the box structure 66. Each of the longitudinal beams has secured thereto at approximately the center point along the length a pillow block 80, each of which pillow blocks journals one end of an axle 82. The axle 82, at a mid-point coincident with a vertical plane containing the center line 27, has securely mounted thereon a pulley wheel 84 connected by a belt 86 to a drive wheel 88 of the motor 76. The pulley wheel 84 has four spokes 90, one of which has secured thereto a weight 85 near the outer periphery of the pulley wheel 84. Operationally, as the pulley wheel 84 is rotated, a rotary eccentric motion is imparted by the weight 85 to the wheel 84 and axle 82, which motion is transmitted through the pillow blocks 80 to the box structure 66. The box structure 66 is free to move as a result of its connection to the main support 12 through the flexible connection 14.

The oscillatory motion is seen at the deck 16 as an alternating velocity interrupted by a frequency and amplitude control 94. The velocity toward the feed end 20 is greater than the velocity toward the discharge end 22 as a result of the rotation of the wheel 84, the weight 85 and the frequency amplitude control 94.

The amplitude and frequency at which the oscillator assembly 18 oscillates the box structure 66 and connected deck 16 is controlled by the frequency amplitude control assembly 94. (FIG. 4) A bumper 96 is connected to the underdeck 68. The bumper 96 includes a horizontal portion connected, as by bolts, to the underdeck 68 and a vertical portion extending downwardly from the underdeck toward, but not all the way to, the upper base structure 52. A stop support 98 is connected across the upper base structure 52 between the lateral braces 54 near the feed end 20 of the concentrator 10. The stop support includes a horizontal cross beam and a vertical cross beam 100 and 102. At the exterior angle defined by the two cross beams 100 and 102, a vertical plate 104, having a bumper stop pad 106, is attached. The vertical plate is abutted by a horizontal plate 108 secured to the horizontal beam 100. A spring biased pivot arm 110 is pivotly connected at its midpoint to a support post 112. The support post 112 connects to the vertical cross beam 102 and projects perpendicularly away therefrom. A contact end 114 of the pivot arm is laterally adjacent to the pad 106 with the bumper 96 positioned intermediate thereof. A spring end 116 of the pivot arm 110 is connected to one end of a spring 118, another end of the spring 118 being connected to an adjustment bolt 120 passing through the lateral brace 54 at the feed end 20 of the concentrator 10. Adjustment of the tension in spring 118 by threadably advancing or retracting the adjustment bolt 120 relative to the brace 54 controls the damping applied to the frequency assembly 94 and therefore the amplitude of the force applied to the deck.

The space between the contact end 114 of the pivot arm 110 and the pad 106 of the frequency assembly 94 also determines the distance the deck travels during a cycle, thus changing the frequency of that movement. The closer together the stop pad 106 and the contact end 114, the higher the frequency at which the deck 16 is oscillated by the oscillating assembly 18. The greater the distance between the contact end 114 and the stop pad 106, the lower the frequency but the greater the distance the deck 16 travels before the direction of travel is reversed or interrupted, resulting in greater force transmitted to the deck at a lower frequency, or less force at a higher frequency.

It will be understood that the movement of the deck 16 is under the impetus of the oscillator assembly 18. The pulley wheel 84 of the oscillator assembly 18 rotates in a clockwise direction as seen with reference to FIG. 4. The weight 85 imparts oscillation and velocity to the deck when interrupted by the stop pad 106, raw material on the deck is thrown toward the discharge end 22, much like pulling a table cloth out from under a dinner setting. The net result is that raw material on the deck 16 moves from the feed end 20 toward the discharge end 22.

An alternative embodiment of the oscillator assembly, like parts being given prime suffixes, is seen in FIGS. 11 through 16. The physical structure of the connection between the deck 16' and the box structure 66' and flexible support 14' is essentially the same as has been previously discussed and is best seen in FIG. 13. The motor 76' is secured to the upper base structure 52', rather than to the main support base 12, as was the case in the preferred embodiment. An additional beam 190 extending between the lateral braces 54' of the upper brace structure 52' is provided, to which beam 190 the motor 76' is rigidly connected, as by bolting. The beam 190 also supports a pillow block 192 which journals a main drive axle 194 therethrough. The main drive axle 194 extends either side of the beam 190. As seen in FIG. 12, the main drive axle 194 at one lateral side projection from the beam 190 is secured to a pulley wheel 84', which pulley wheel 84' is turned by the motor 76' and belt 86'.

At the other lateral side extent, the main drive axle 194 is integrally formed or connected to an offset or extension axle 196 (FIGS. 15 and 16). The geometric center of the extension axle 196 is displaced away from the geometric center of the main drive axle 194 a preestablished offset distance 198. The extension axle 196 is secured to a rubber edged extension wheel 200, which extension wheel 200 is rotated by the motor 76' in a vertical plane containing the center line 27 (FIG. 12). The extension wheel is in continuous contact with a second rubber edged wheel 202, preferably of the same dimension as the extension wheel 200. The second rubber wheel 202 is connected to the underdeck 68' of the deck 16' by an adjustable spacing means assembly 204 (FIG. 14).

The adjustable spacing assembly 204 includes a pair of stationary supports 206 connected to the underdeck 68', oriented transverse to the longitudinal center line 27 of the concentrator. A pair of slide rods 208 are fixedly connected through the fixed supports 206 in a parallel relationship to each other at a spaced distance below the underdeck 68'. The slide rods 208 carry slidably therealong a U-shaped wheel support 210 having a horizontal portion 212 with bores therethrough within which bores the slide rods 208 are received. Two vertical portions 214 of the support 210 extend away from the underdeck 68' and receive an axle portion therethrough, on which axle portion the second rubber wheel 202 is rotatably supported. One of the fixed supports **206*a* receives threadably therethrough intermediate the positions of the two slide rods 208 an adjustment bolt 218, one end of which is rotatably connected to the horizontal portion 212 of the wheel support 210. Relative movement of the adjustment bolt 218 to the fixed support 206*a* moves the entire wheel support 210 and second wheel 202 relative to the fixed position of the extension wheel 200**.

It will be understood by those of skill in the art, and from what has been previously said in relation to the first embodiment of the oscillator assembly 18, that rotation of the motor turns the extension wheel 200 in an eccentric manner. The second wheel 202 is contacted, moving the deck 16' in an oscillating manner along a longitudinal axis thereof.

A bumper assembly 220 is constructed identically to the second rubber wheel 202 and adjustable spacing means assembly 204 just described. The bumper assembly 220 is likewise connected to the underdeck 68'. A wheel 222 of the bumper assembly is adjustable relative to the rigid upper base structure 52' for intermittent adjustable contact with a stop 224 secured to one of the lateral braces 54' of the upper brace structure 52'. A spring 226, bolt 227 and rotatable connection 225 damp the movement of the box structure 66' relative to the main support.

From the foregoing, it will be seen that the motor 76' and the structure attached thereto, including the adjustable spacing assembly 204 perform the same function as does the oscillator assembly 18 in the preferred embodiment. Likewise, the bumper assembly 220 and bias in the spring 226 are adjustable for the same purpose as the frequency control assembly 94 of the preferred embodiment. Various ocsillatory motions can be created by use of the various adjustments previously described. The concentrator 10 can operate as a jerking table, or one of the intermittent forces available can be introduced to make a bumping table. Variations of both are available and may be used in best processing a given material.

Figure 5:
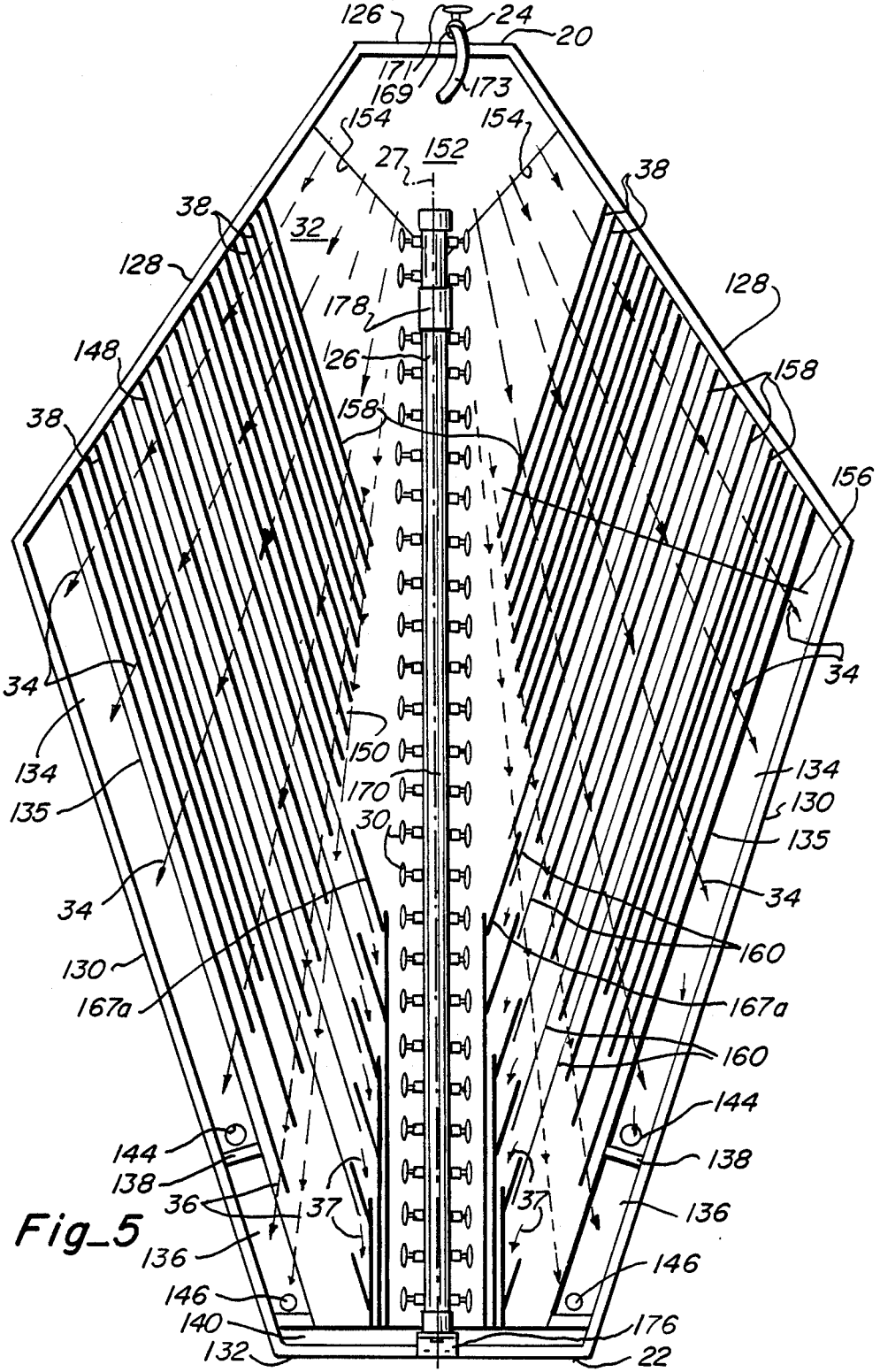
FIG. 5 is a top plan view of the invention shown in FIG. 1, flow paths for raw material being shown in diagramatic form.

The deck 16 is best seen in FIGS. 1, 3, and 5 through 8. The deck 16 can be made of either metal or wood and includes an integral area including the two sloping surfaces 32. The underdeck 68 is connected by the bolts 72 to the box structure 66 as previously described. The deck is seen in FIG. 5 to be an irregular hexagon in the plan view, symmetrical about the longitudinal center line 27. A containment wall 124 extends around the outer periphery to hold the raw material and water. At the feed end 20, a feed end wall 126 extends perpendicularly away from the center line. Extending towards the discharge end 22 at either termination of the feed end wall 126, are a pair of first side walls 128 extending toward the discharge end 22 approximately thirty to forty percent of the overall length of the deck 16. A second pair of side walls 130 form an obtuse angle with the first side walls 128 and converge towards the discharge end 22. The second side walls 130 terminate at a discharge end wall 132, again oriented perpendicular to the center line bisecting the deck 16.

At either side of the deck 16, immediately adjacent to the second side walls 130, and extending from the connection of the second side walls 130 to the first side walls 128, and for a predetermined distance along the length of the side wall 130, a tailings trough 134 is formed on either side of the deck. As best seen in FIG. 3, the tailings trough 134 is stepped down from the lateral termination of the sloping surfaces 32 at step 135. A separation wall 138 keeps tailings material 34 in the tailings trough 134 and away from a middlings trough 136. In turn, the middlings trough 136 is separated from a concentrate collection trough 140 by a second separation wall 142. The concentrate collection trough 140 extends across the discharge end 22 of the deck 16 and adjacent to the discharge end wall 132.

As will be discussed in more detail hereinafter, the tailings trough 134 receives light waste material or tailings 34 washed from the feed end 20 and funnels the tailings toward a tailings discharge hole 144 adjacent to the first separation wall 138. In a similar manner, relatively heavier raw material in the form of the middlings 36 is directed by the recessed riffles 38 and the water flow from the feed end 20 to the middlings trough 136 and hence funnelled to the middling discharge hole 146 adjacent the second separation wall 142. Concentrate material 37 travels along the riffles 38 to the concentrate collection trough 140, and is discharged through a discharge hole 147.

As best seen in FIG. 4, the sloping surfaces 32 of the deck 16 have a compound pitch or slope, a downward longitudinal grade or pitch from the feed end 20 to the discharge end 22 and a lateral pitch from the center line to the side edges. The longitudinal grade or pitch is preferably about one quarter inch per lineal foot, while the lateral pitch is preferably between three eighths and one half inch per lineal foot. A steeper grade is followed by the tailings trough 134 and the middlings trough 136 tending to direct their respective materials to the discharge holes 144 and 146. A tailings flow path 148 is seen diagrammatically in FIG. 5 as is a middlings flow path 150. A separation pattern can be seen diagrammatically in FIG. 5.

The texture of the sloping surfaces 32 is important to the overall function of the concentrator 10. The surfaces 32 should not be smooth but rather toothy or textured. A desirable surface texture is achievable with chalkboard paint, an oil based paint with a powdered silica, silicate or slate filler.

Within the containment wall 124 at the feed end 20 and adjacent to the first water supply 24 is a feed area 152 onto which the raw material is initially placed into a hopper by a mechanical feeder (not shown) or is discharged from another concentrator. The feed area extends a relatively short distance of the length of the deck, ten to twenty percent, and terminates at two side steps 154 which discharge the fine raw material and water from water supply 24 onto the sloping surfaces 32.

But for the area required for the troughs 134, 136 and 140 and the feed area 152, the sloping surfaces 32 extend over the remaining area of the deck 16. The sloping surfaces 32 pitch downwardly both along the length of the deck from the feed end 20 to the discharge end 22 and laterally downward from the center line to the troughs 134 and 136 (FIG. 3).

A fall line 156 is seen to be the line that an ideal perfectly spherical particle would take down either of the sloping surfaces 32 were none of the riffles 38 present. Changing the pitch or inclination of the sloping surfaces, either laterally or longitudinally, alters the fall line 156. Using the fall line 156 as a reference, the riffles 38 are formed generally perpendicularly thereto. Measuring an angle made by the riffles 38 with the center line 27, referenced at the feed end 20, an acute angle is defined between the center line and the riffles 38 on the order of 20 to 35 degrees. It should be noted that once the concentrator deck 16 is made, the fall line 156 remains fixed, as does the orientation of the riffles 38 relative thereto. Changing the orientation of the deck 16 would alter the fall line and riffle functions. Different density materials and particle sizes are therefore concentrated by coordinating the frequency at which the oscillator assembly 18 moves the deck 16, the amplitude of the force transmitted to the deck 16 on each impact of the bumper 96 against the stop pad 106, and the water flow rates from the first and second water supplies 24 and 26.

As seen in FIG. 5, the riffles 38 extend from the first side walls 128, terminating at ever increasing distances along the length of the deck 16. At the termination of a given riffle 38, the depth of the riffle is tapered away to terminate flush with the sloping surface 32 as seen in FIG. 8.

The riffles 38 are of four different types, three of which are relatively wider and deeper 158, 167 and 168 (FIGS. 6, *7a* and *7b*), and can be of arcuate or square cross section, preferably arcuate. With reference to FIG. 5, the first set of eight riffles are of a relatively larger type first riffle 158. These riffles are particularly well-suited to receiving the raw material and keeping the concentrate 37 (FIGS. *7a* and *7b*). Beginning with the ninth riffles, relatively shallower and narrower fine concentrating second riffles 160 alternate with the riffles 158 (FIG. 6). Both riffles 158 and 160 start at the walls 128 and extend toward the discharge end 22. The fine riffles 160 are on the order of one sixteenth to three sixteenths of an inch across and one thirty-second to one sixteenth of an inch deep. The riffles 158, 167 and 168 are approximately one fourth to three eights of an inch across and one sixteenth to one eighth of an inch deep. Each of the concentrating second riffles 160 extends a greater distance along the length of the deck 16 than does the corresponding first riffle 158.

Most of the tailings 34 are washed directly down the sloping surfaces 32 to the tailings trough 134 for disposal. Three other first riffles 158 near the edge of the deck 16 are relatively shorter than preceding riffles 158. Material in these three riffles 158 is primarily tailings displaced from preceding riffles 158 and 160 by denser materials. At the termination of these last riffles 158, the tailings 34 follow the tailings flow pattern 148 to the tailings trough 134 for disposal through the discharge hole 144. At the termination of most of the riffles 158, the middlings 36, having previously displaced the lighter tailings 34 adopt the middlings flow path 150 to the tailings trough 136, and are discharged through the middlings discharge hole 146 (FIG. 5).

The longer fine riffles 160 extend to a point where they discharge primarily concentrate 37 to a receiving end of the relatively short third riffles 167, which extend parallel to riffles 158 and 160. Less dense middlings 34 do not reach the riffles 167 on exiting a riffle 160, and join the middlings flow path 150. Each of the third riffles 167 is downstream of an associated fine riffle 160 except for the first concentrate riffle 167*a*, which receives any concentrate mineral that might have come from any of the upstream riffles 158. The third riffles 167 carry the mineral, such as gold, being concentrated to longitudinally extending fourth feed riffles 168 which extend parallel to the center line 27 of the deck 16 carrying the mineral or gold in the remainder of the length of the deck 16 and into the concentrate collection trough 140 for removal through hole 142.

The first water supply 24 has a feed pipe 169 connected to a water utility supplier or other water source. The flow rate is governed by a valve 171. An outlet 173 carries water over the feed end wall 126 and discharges it onto the feed area 152 with the raw material. The water supply 24 is not connected to the deck 16, which oscillates beneath the outlet 173.

The second water supply 26 includes a longitudinally extending flow pipe 170 extending from the feed area 152 to the concentrate collection trough 140. A plurality of the valves 30 and the spigots or outlets 28 are formed in equal numbers and at equal positions along the length of the feed pipe providing for independant flow control of the amount of water passing onto the sloping surfaces 32. A support bracket 176 carries the terminal end of the feed pipe 170 while an inlet coupling 178 brings water from below the deck 16 into communication with the feed pipe 170. The inlet coupling 178 is flexible rubber or the like to permit the unimpeded oscillation of the deck 16.

In operation, a film of water is deposited across the entire deck surface including the feed area 152 and sloping surfaces 32. The rate of water supplied is generally on the order of 5 to 20 gallons per minute, depending upon the particle size and particle density of the raw material being processed. Once the film of water has been established, raw material having a predetermined size of between minus ten and minus twenty mesh is deposited in the feed area 152 from a continuous feed hopper (not shown) or other raw material source at a preestablished controlled feed rate.

The raw material is washed from the feed area 152 by its own inertia as the deck 16 is jerked or bumped out from under the material by the oscillator assembly 18 operating at frequency of between 190 and 500 cycles per minute. Lighter tailings 34 materials has little momentum and tend to be simply washed by the water down to the tailings trough 134 along the tailings flow path 148.

Relatively heavier middlings 36 material, including possibly some material which is to be concentrated, takes the intermediate middlings flow path 150, which generally follows the termination of the first riffles 158, to the middlings trough 136.

The heaviest most dense concentrate 37 tend to stay in the bottoms of the riffles 38 and ultimately move to one of the second riffles 160. Once in one of the riffles 160, the concentrate 37 has sufficient mass relative to its particle size so as to ride in the bottom of the riffle 160 until its termination, as seen in FIG. 8. Upon termination of one of the second riffles 160, the gold or other mineral is further concentrated and cleaned at this point, and is then transferred into the third riffles 167, any middlings 36 being separated to join the middlings flow path 148. The concentrate 37 moves along the fourth riffles 168 to the concentrate trough 140 for collection.

In summary, the orientation of the sloping surface 32, the various types and orientations of the riffles 158, 160, 167 and 168 separate the concentrate 37 from the remaining raw material at several stages throughout the movement of the raw material from the feed end 20 to the discharge end 22. As will be understood by those of skill in the art, variation of the frequency of oscillation and energy applied, the water flow rate, and the rate of feed of raw materials, all will have an effect on the movement on the raw materials. The raw material feed rate is dependent on deck size, but is between two hundred fifty and two thousand pounds per hour, for a relatively dense raw material and for a deck of between eighteen square feet and forty-five square feet of total surface area. The frequency control assembly 94 is used for adjustment of the frequency and energy applied, while the valves 30 are used to fine tune the water flow rate for the best possible yeilds of concentrate 37.

Alternative embodiments of the riffles and deck of the invention are seen in FIGS. 9 and 10. FIG. 9, wherein like elements are given the same number as the preferred embodiment with a prime suffix, is very similar to the preferred embodiment, absent only second, third, and fourth riffles 160, 167 and 168. In other respects the concentrator 10' of FIG. 9 operates in a similar manner. The embodiment of FIG. 9 is best used for high volume applications with large particles, raw material feed rates of one thousand pounds per hour for a forty-five square foot deck surface area, to initially concentrate a mineral or gold.

The embodiment of FIG. 10, like elements to the preferred embodiment being given a double prime suffix, is best used in series with the embodiment shown in FIG. 9 for finer size feed material. Concentrate holes 182 receives the concentrate, which is collected in a container (not shown) secured therebeneath. The embodiment of FIG. 10 utilizes riffles 38" of the same relative smaller cross sectional size as the second riffles 160 of the preferred embodiment for purposes of collecting the concentrate at an early part of the separation process. Concentrates are separated and collected in riffles 38" similar to the process described relative to the preferred embodiment. As the raw material moves in the riffles 38" toward the discharge end 22", the concentrate is cleaned of lighter, less dense, raw materials. The embodiment of FIG. 10 is best used for relatively smaller volume particle sizes, minus twenty mesh, where an initial concentration of material has been made for completing the separation and cleaning of gold and heavy minerals.

Although the invention has been descibed with a certain degree of particularity, the scope of the invention is more particularly defined in the appended claims.

What is claimed is:

1. A mineral concentrator device for a raw material mixture having particles of a size less than a preestablished maximum and of different physical densities, comprising in combination:

a deck connected to a support base by a flexible connection and an adjustable frequency oscillation means for intermittently moving said deck along a longitudinal axis thereof at a selected frequency and at a higher velocity toward a feed end of said deck than the velocity toward a discharge end of said deck, said deck including a flat planar feed area for receiving raw material and wash water from a first water supply said first water supply providing said wash water to said feed area and said deck having a sloping surface with a downward pitch longitudinally and laterally from said feed area downwardly terminating at two lateral opposite side edges in a waste trough for carrying away relatively less dense waste material and at the discharge end terminating in a discharge trough for receiving relatively denser concentrate material, a second water supply extending longitudinally along the center of and adjacent to said deck, said second water supply having a plurality of water outlets therealong associated with said sloping surface, a first set of grooves formed near said feed end associated with the sloping surface of said deck, the first set of grooves being of relatively greater depth and width for receiving raw materials, said first set of grooves extending generally longitudinally and forming an acute angle with said second water supply relative to the feed end of the deck, said first set of grooves further oriented so that wash water and entrained raw materials enter said first set of grooves along a flow path essentially perpendicular to the first set of grooves, a second set of grooves of relatively lesser depth and width than said first grooves formed in said deck, said second grooves extending a greater linear distance from said feed end than said first grooves, said second grooves for receiving relatively more dense material which displaces lighter materials in said second grooves, said second grooves oriented parallel to said first grooves and interspersed among said first grooves, third grooves parallel to said first and second grooves for receiving the discharge from said second grooves and having a depth and width similar to that of said first grooves, said third grooves extending from a position adjacent the termination of said second riffles toward the discharge end, said third grooves in communication with a fourth set of grooves in communication with said discharge trough, whereby less dense material moves down the sloping surface to said waste trough while more dense concentrate material moves toward the discharge trough via said first, second, third and fourth grooves for recovery.

2. The invention as defined in claim 1 wherein the lateral pitch is between three-eighths and one-half inch per lineal foot and the longitudinal pitch is approximately one-quarter of an inch per lineal foot.

3. The invention as defined in claim 1 wherein said sloping surface has a textured surface formed by a coating of oil based paint mixed with powdered texture materials.

4. The invention as defined in claim 1 wherein said flexible connection includes a pair of flexible panels connected to said support base and to a rigid box structure held in a superimposed position above said support base, said box structure rigidly connected to said deck.

5. The invention as defined in claim 1 wherein said oscillation means is a rotating eccentric connected to said box structure.

6. The invention as defined in claim 4 wherein said oscillation means includes a rotating eccentric connected to said support base and rotating means in contact with said rotating eccentric operably connected to said deck and box structure for transmitting eccentric rotation to said deck in the form of longitudinal oscillations.

* * * * *